US005353582A

United States Patent [19]

Citterio et al.

[11] Patent Number: 5,353,582

[45] Date of Patent: Oct. 11, 1994

[54] SYSTEM FOR CONTROLLING THE MOVEMENT OF AN ELONGATED TEXTILE STRUCTURE

[75] Inventors: Giorgio Citterio, Horgen; Stefan Huppi, Baar; Urs Meyer, Niederglatt; Walter Slavik, Horgen, all of Switzerland

[73] Assignee: Rieter Machine Works, Ltd., Winterthur, Switzerland

[21] Appl. No.: 746,005

[22] Filed: Aug. 9, 1991

Related U.S. Application Data

[63] Continuation of Ser. No. 604,998, Oct. 25, 1990, abandoned, which is a continuation of Ser. No. 336,160, Apr. 11, 1989, abandoned.

[30] Foreign Application Priority Data

Apr. 14, 1988 [CH] Switzerland ..... 01385/88

[51] Int. Cl.[5] ..... D01H 4/50

[52] U.S. Cl. ..... 57/263

[58] Field of Search ..... 57/263, 261, 90, 91, 57/100; 318/605, 617, 618, 654, 600, 601, 603

[56] References Cited

U.S. PATENT DOCUMENTS

| | | | |
|---|---|---|---|
| 3,040,221 | 6/1962 | Fitzner | 318/605 X |
| 3,241,015 | 3/1966 | Allen | 318/617 X |
| 3,614,577 | 10/1971 | Honeywell et al. | 318/654 |
| 4,276,742 | 7/1981 | Raasch | 57/263 |
| 4,300,663 | 11/1981 | Hmelovsky et al. | 318/617 X |
| 4,327,546 | 5/1982 | Derichs et al. | 57/263 |
| 4,469,993 | 9/1984 | Swanson et al. | 318/603 X |
| 4,494,371 | 1/1985 | Morita et al. | 57/263 |
| 4,628,684 | 12/1986 | Morita et al. | 57/263 |
| 4,689,945 | 9/1987 | Lattion et al. | 57/22 X |
| 4,712,367 | 12/1987 | Lassmann | 57/263 |
| 4,856,269 | 8/1989 | Briner et al. | 57/263 |

FOREIGN PATENT DOCUMENTS

| | | |
|---|---|---|
| 3634992 | 4/1987 | Fed. Rep. of Germany . |
| 1391211 | 4/1975 | United Kingdom . |

OTHER PUBLICATIONS

Tal, Jakob, "Motion Control of Microprocessors", Galil Motion Control, Mountain View, Calif. 94043, pp. III-1 to III-7, date unknown.

*Primary Examiner*—Joseph J. Hail, III

*Attorney, Agent, or Firm*—Francis C. Hand

[57] ABSTRACT

The control system uses a digital position controller for controlling the movement of a yarn end for re-piecing, for example in a rotor spinning machine. The control system is distance-dependent such that the position of the yarn end at a given time provides a control for the speed of the yarn end back to the target position.

11 Claims, 7 Drawing Sheets

Fig. 4
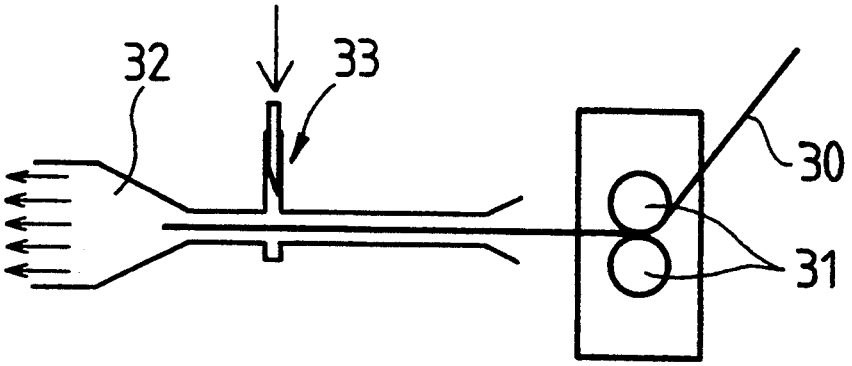
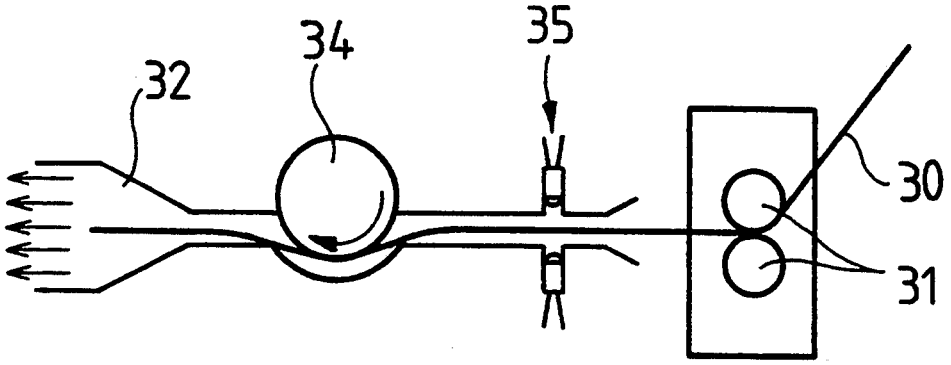
Fig. 5

Fig. 9
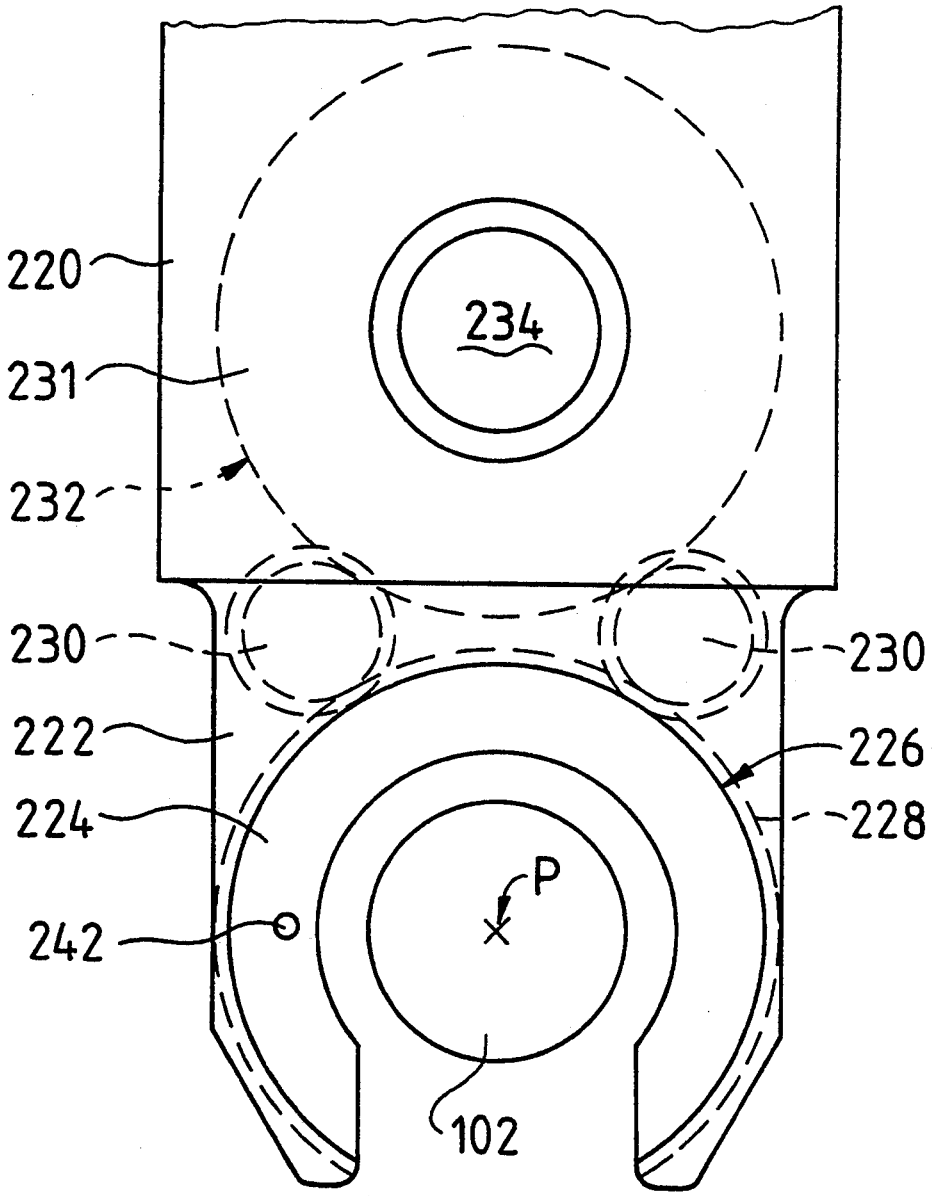
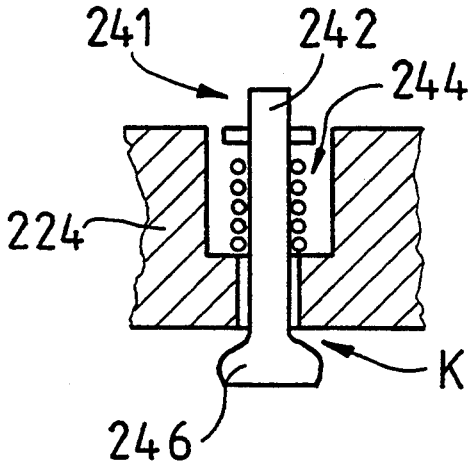
Fig. 10

SYSTEM FOR CONTROLLING THE MOVEMENT OF AN ELONGATED TEXTILE STRUCTURE

This application is a continuation of application Ser. No. 07/604,998, filed Oct. 25, 1990, which is a continuation of U.S. Ser. No. 07/336,160, filed Apr. 11, 1989 both now abandoned.

This invention relates to a system for controlling the movement of an elongated textile structure. More specifically, this invention relates to a system for controlling the movement of a yarn, slubbing or sliver. Still more particularly, this invention relates to a system for controlling the movement of a yarn in a piecing device for a spinning machine.

As is known, the piecing operations effected by piecing devices for spinning machines have been controlled in dependence on time. To this end, individual operations, such as switching motors on and off and actuating couplings and solenoid valves have been controlled by a chronological program with the completion of the relevant actions is usually being monitored by sensors, such as limit switches, pressure switches and light barriers. This monitoring enables certain operations to be discontinued when reaching their objective and, if necessary, another operation to be started after conclusion of a certain operation.

Devices for performing this type of operation are described in German Patent 3 634 992 and U.S. Pat. No. 4,327,546. In particular, the type of control described originates from the technology of mechanical program switches, in which the program sequence is determined by a number of cam discs rotated by a motor at a constant speed. However, modern microprocessor technology has directly taken over this structure. Instead of the shaft and cam discs rotating at constant speed, there is now simply an internal time counter. Very complex sequences are divided up into discrete operations which are, in turn, individually time and sequence controlled and which are processed individually by the microprocessor. This type of control is shown in FIG. 6 of U.S. Pat. No. 4,327,546.

The basic disadvantage of the type of control described is that any deviation in speed, e.g. due to voltage fluctuations or motor heating, results in significant deviations in the yarn length delivered by the drive in the given time. Two steps are applied to obviate this.

First, before the end position is reached, the yarn drive is switched to inching and then runs at low speed until the specific end position is reached. This is the solution found in conventional control technology and provides the required accuracy of the end position at the expense of increased time.

Second, the yarn movement is generated by mechanical levers with fixed stops (German Patent 36 34 992, FIG. 3). Although the distance covered is accurately limited in this way, the speed is left to the free play of masses and forces, resulting in defective reproducibility of the time sequences.

German O.S. 21 30 690 and corresponding British Patent 1,391,211 describes a method in which the length of a piece of yarn fed back in a piecing process is controlled by counting pulses and these pulses are generated in dependence on the rotation of a feed roller. The counting process is initiated by detecting the end of the piece of yarn to be fed back. A method of this kind, however, only attempts to fix the beginning and end of the yarn end movement.

Accordingly, it is an object of the invention to provide an appreciable improvement in the accuracy of movement systems for the movement of elongated structures.

It is another object of the invention to accurately perform a re-piecing operation in a yarn spinning machine.

It is another object of the invention to improve the re-piecing of yarns in spinning machines.

It is another object of the invention to improve the quality of yarn which has been spun in a spinning machine.

It is another object of the invention to provide a relatively inexpensive system for the re-piecing of elongated textile structures such as yarns, slubbings and slivers.

Briefly, the invention provides a system for controlling the movement of an elongated textile structure such as a yarn, slubbing or sliver. The system includes a movable element for moving the elongated textile structure longitudinally of the length thereof, drive means connected with the element for moving the element and a closed loop control circuit connected with the drive means for continuously controlling the position of the movable element during movement thereof. In this respect, the control circuit serves to continuously or pseudo-continuously control the position of the movable element.

The movable element may be in the form of a drive roller of a pair of rollers between which the textile structure is driven.

The drive means may, advantageously include a motor with a rotatable shaft for driving the drive roller of the roller pair. In this case, the roller is rigidly coupled to the shaft of the motor.

The control circuit may be a programmable device which, starting from a determinable initial position and a predetermined target or end position, can calculate a pre-programmed set-value movement sequence and compare the actual sequence continuously or pseudo-continuously during the movement with the set-value sequence and transmit appropriate corrections to the drive means. The device may also be programmable with respect to required speed or acceleration. Devices of this kind are available commercially, for example, from Galil Motion Control, Inc., 1054 Elwell Court, Palo Alto, Calif., under the name MCC-3000 (Motion Control Chip Set). The theory and operation of such devices are described in the publication "Motion Control of Micro Processors" by Jakob Tal, this publication being available from Messrs. Galil Motion Control, Inc.

The system is of particular advantage in connection with piecing processes in spinning machines. In such processes, the movement of a yarn end must be accurately controlled so that the other operations (e.g. feeding in of fibres) can be performed accurately in connection with this controlled movement. This applies, for example, to piecing in rotor spinning methods, as described in U.S. Pat. No. 4,689,945 and also to piecing processes for air jet and/or friction spinning, e.g. as described in U.S. patent applications Ser. No. 07/186,114, filed April 1988 now U.S. Pat. No. 4,856,269 and Ser. No. 07/288,415, field Dec. 22, 1988. Yarn movements of this kind can be performed very satisfactorily with the above system, the moveable element being formed by a rotatable roller cooperating with a companion roller to move the yarn. In that case, only one roller is driven positively by the drive means while the companion roller is driven only by contact with the first roller. A pair of rollers of this kind is known per se from German O.S. 27 11 554 and corresponding U.S. Pat. No. 4,276,742.

These and other objects and advantages of the invention will become more apparent from the following detailed description taken in conjunction with the accompanying drawings wherein:

FIG. 1 diagrammatically illustrates a control system in accordance with the invention;

FIG. 2 graphically illustrates a sequence of movements in a piecing process in a rotor spinning machine according to the prior art;

FIG. 3 graphically illustrates a sequence of movements in a piecing process in a rotor spinning machine in accordance with the invention;

FIG. 4 schematically illustrates a device for determining an initial start position of a yarn end in accordance with the invention;

FIG. 5 illustrates a modified arrangement for establishing an initial position of a yarn end in accordance with the invention;

FIG. 6 diagrammatically illustrates a rotor spinning machine constructed in accordance with the invention;

FIG. 7 schematically illustrates a control system for the re-piecing rollers of the rotor spinning machine of FIG. 6 in accordance with the invention;

FIG. 8 graphically illustrates a movement diagram for a "running program" provided by the control system of the invention;

FIG. 9 illustrates an end view of a part of a servicing robot for a ring spinning machine having a controlled winding movement in accordance with the invention;

FIG. 10 illustrates a cross-sectional view of a thread clamping pin used in the servicing robot of FIG. 9;

Figure 11:
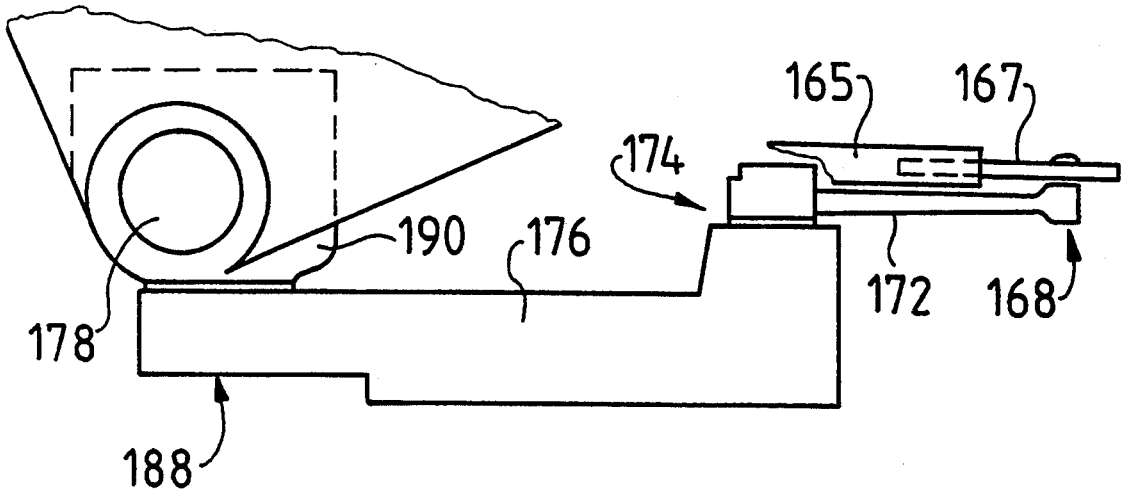
FIG. 11 illustrates a controllable movement system in accordance with the invention employing pivotally mounted levers.
Figure 13:
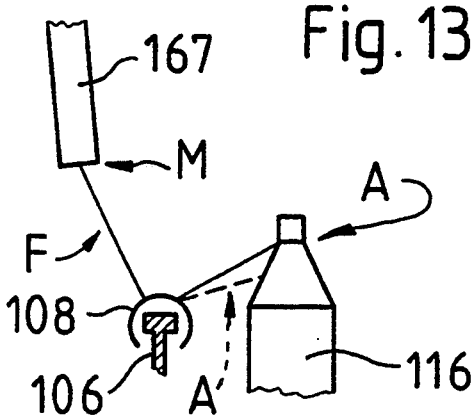
Figure 14:
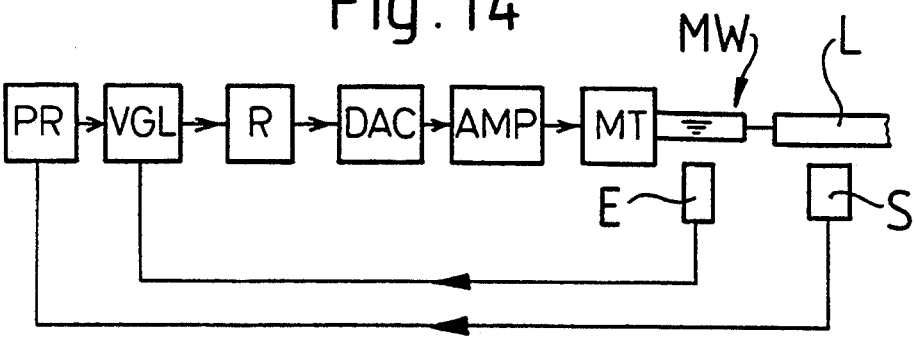

FIG. 13 schematically illustrates the system of FIG. 11 in use with a broken thread of a cop in accordance with the invention; and FIG. 14 illustrates a block diagram of a control for the robot of FIG. 9 and the system of FIG. 11.

Figure 1:
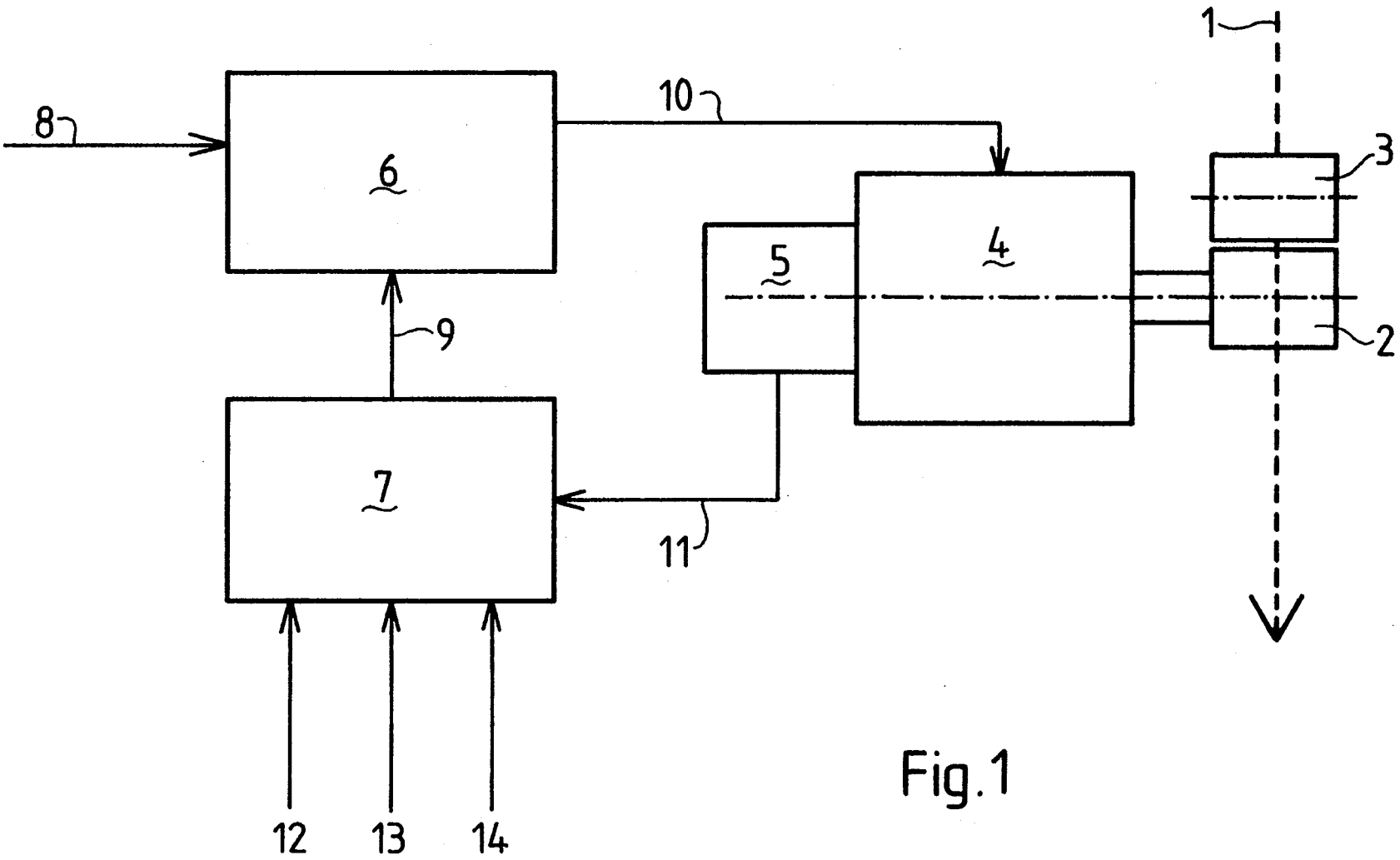

Referring to FIG. 1, a machine in which an elongated textile structure, such as a yarn 1, is movable employs a means in the form of a pair of rollers 2, 3 for moving the yarn 1 longitudinally. In the illustrated embodiment, the two rollers 2, 3 provide a nip for engaging the yarn 1 with one roller 2 constituting a drive roller and the other roller 3 constituting a pressure roller. In addition, the drive roller 2 is connected to a drive means in the form of a motor 4. In this case, the drive roller 2 is mounted on the shaft of the motor 4 so as to be rotated therewith. An incremental synchro (encoder) 5 is also disposed on the same shaft.

The yarn 1 has an end (not shown) which is guided in a known manner by a guide (not shown), for example by a withdrawal passage in a rotor spinning unit for back-feeding into a rotor of the spinning unit.

A closed loop control circuit is also connected with the motor 4 for continuously controlling the position of the end of the yarn 1 between an initial position and a target position, for example, a position within the rotor of the rotor spinning machine. This control circuit includes an electronic power control element 6which receives a feed voltage 8 in order to generate a controlled current 10 which is directed to the motor 4 for running the motor 4.

In addition, the control circuit includes a digital position controller 7 for controlling the speed of the motor 4 in dependence upon the position of the yarn end between the initial position and target position thereof. As indicated, the incremental synchro 5 is connected with the motor 4 in order to emit an output signal 11 representative of the position of the drive roller 2 and, thus, of the yarn end. The controller 7 also has inputs for receiving a set-value signal 12 for the target position, a set-value signal 13 for a predetermined speed of the drive roller 2 for each position of the roller 2 between the initial position and the target position of the yarn and a set-value signal 14 for a predetermined acceleration of the drive roller 2 for each position of the roller 2 between the initial position and target position of the yarn end.

The controller 7 also has an output connected to the power control element 6 to deliver a control signal 9 thereto which corresponds to a difference between the predetermined speed and the actual speed of the drive roller 2 at each position of the roller 2 corresponding to the position of a yarn end.

During operation, from the set-value signals received at the inputs, the position controller 7 calculates the speed associated with each point of the distance to be covered by the yarn end, this speed being the speed set-value. The same controller 7 calculates the actual value of the yarn end position from the output signal 11 and, by differentiation with time, the actual speed. From the three available values: actual position, speed set-value, and actual speed, the control signal 9 for the power control element 6 is determined by known controller algorithms.

A suitable position controller for use in the control circuit is available from the above-mentioned company Galil Motion Control, Inc., under the name Motion Control Chip Set MCC-300.

Figure 2:
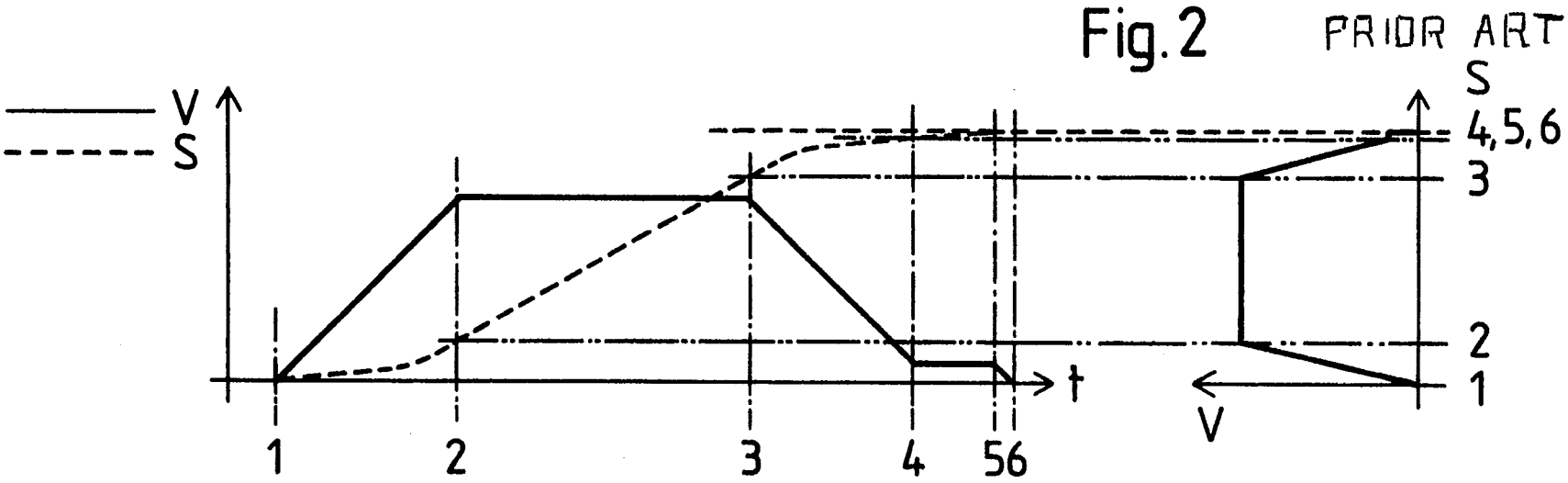
Figure 3:
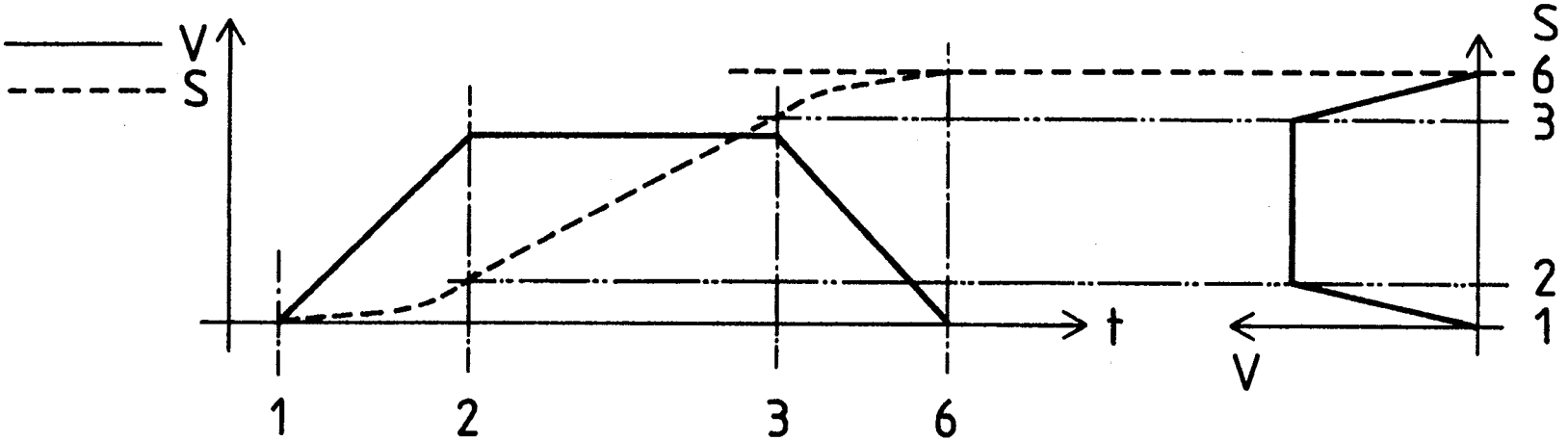

FIGS. 2 and 3 show the difference between a prior art time-dependent control and the above described distance-dependent control of the yarn feed. In the left-hand part of each diagram, the speed V (vertical axis) is shown against time t by the solid line. The same diagram shows the distance S covered as a broken line. The right-hand part separately shows in an associated projection the speed V against the distance S.

FIG. 2 shows the conventional type of control. The movement operation starts at time 1. After a constant acceleration phase, the required feed speed is obtained at time 2 and then retained until time 3. At that time, deceleration starts. If relatively large tolerances are accepted at the stopping point, this deceleration phase ends directly with standstill. Since errors are cumulative in this method, the approach to the required final position is normally carried out by inching. The change to the slow speed takes pace at time 4, a brake engages at time 5 and the end position is reached at time 6.

In contrast, FIG. 3 shows the distance-dependent control. Running up to speed and feeding at constant speed up to changeover point 3 (initiation of braking operation) take place basically in the same way as in the time-dependent control. The changeover point 3 is now determined not in dependence upon time, but upon distance, and the deceleration operation is also controlled in dependence on distance. Thus, the target position is achieved without any loss of time and without any irregularity in the motion. The distance-dependent control of the yarn speed obviates divergence in the position of the yarn end and in the residence time of the yarn end in a twist means of a spinning machine and thus provides the guarantee for a reproducible piecing operation.

An important factor for high accuracy of yarn motion is that the drive roller 2 (FIG. 1) should be coupled rigidly to the motor shaft in respect of rotation. Advantageously, therefore, the drive roller 2 is mounted directly on the motor shaft or the two elements are at least connected by a short coupling which is rigid with respect to rotation.

Another important factor regarding accuracy of the piecing operation is that the end of the seed yarn should be accurately engaged as a reference for the complete movement. Two different methods are possible for this and are shown in detail in FIGS. 4 and 5.

In the first method (FIG. 4) the end of the yarn 30, after being drawn into a pair of drive rollers 31 (which correspond to the roller pair 2, 3 shown in FIG. 1), is tensioned and cut off at a specific distance. A suction tube 32 in conjunction with a yarn severing means, such as a cutter 33, is used for this purpose. This method is already known in connection with uncontrolled yarn drives but has a disadvantage in that a clearly defined cut of the yarn end has an adverse effect on the formation of the piecing yarn. In this respect, an opened-up yarn end of the kind that forms, for example, by a grinding operation, is more favorable. Severing the yarn by grinding, however, means that the accurately defined distance between the drive roller and the point of severance is lost.

The second method (FIG. 5) is therefore based on a separate engagement of the yarn end. In this case, the yarn 30 is severed by a grinding disc 34 and then pulled back by the drive itself. During this operation, the yarn end passes a broken-end detector 35, e.g. in the form of a photoelectric barrier in the tube 32. As soon as the yarn end passes the barrier 35, the signal "no yarn" is given and, in turn, fixes in the drive control system the value for the yarn length as being the distance between the pair of drive rollers 31 and the photoelectric barrier 35. Thus, the detector 35 operates as a means for establishing an initial position of the yarn (textile structure) by reference to a determinable position on the textile structure (i.e. the yarn end). Referring to the Galil Motion Control Chip Set, this signal corresponds to the command DH "Define Home".

Other electronic control circuits are known apart from the other variants provided by Galil Motion Control Inc. which may be used. A digital system based on the microprocessor technique is advantageous, but an analog system is feasible.

The sequence shown in FIG. 3 is not essential. For example, in connection with a jet spinning method, the back-feed phase need not always be accurately controlled. In some cases, it would be sufficient to determine the initial position of the yarn end and to pull the yarn end out of this initial position through a yarn forming station using a motion system with a join being formed when the yarn end is pulled through this yarn forming station. A controlled motion of the yarn then takes place in only one direction.

Instead of using a roller as the movable element which is controlled, the movable element may be a clamping element while the drive means is a linear motor and the control circuit controls the linear motion of the motor.

In order to illustrate the potential use and advantages of the control system, an example of use in connection with piecing in a rotor spinning machine will now be explained in detail with reference to FIGS. 6 and 7.

Figure 6:
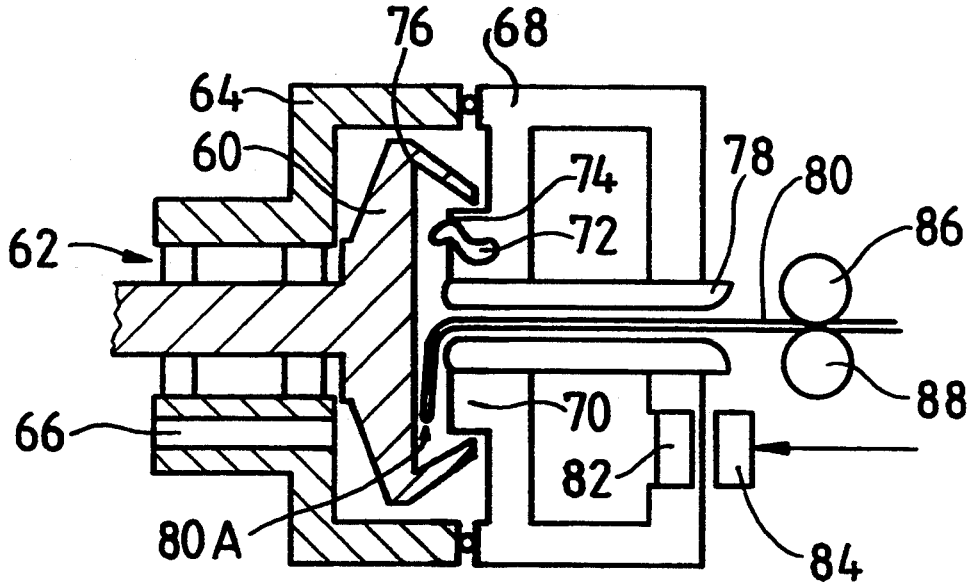

FIG. 6 diagrammatically illustrates a rotor spinning machine comprising a rotor 60, a rotor bearing 62, a housing 64, a suction duct 66 and a cover 68. The cover 68 is movable relative to the housing 64 in order to close (FIG. 6) or open the housing 64 and, at the same time, expose the rotor 60.

The cover 68 has a projection 70 which, when the housing 64 is closed, projects into the open end of the rotor 60. A feed duct 72 extends between a fiber feed (not shown) and an orifice 74 in the projection 70. Fibers can be fed through the duct 72 into the rotor 60 to form a fiber ring in a rotor groove 76 in a stream of air. The air flows between the rotor edge and the cover 68 and out of the housing 64 through the suction duct 66.

The cover 68 also comprises a withdrawal duct 78, through which the yarn formed can be withdrawn in normal operation and, for piecing purposes, an auxiliary (seed) yarn 80 can be fed into the rotor 60, as will be described hereinafter. A sensor 82 is also provided in the cover 68 and can respond to a signal transmitter 84 to initiate the fiber feed through the feed duct 72.

The signal transmitter 84, together with a pair of rollers 86, 88 and a control circuit 90 (FIG. 7) is carried by a mobile piecing device (not shown). The device can be positioned as necessary at the spinning machine shown in FIG. 6 to carry out a piecing operation. In this context, "piecing" is equivalent to "starting spinning", i.e. no distinction is made between re-starting after a yarn breakage and re-starting after the machine has been shut down.

The pair of rollers 86, 88 is equivalent to the pair of rollers 2, 3 (FIG. 1). The roller 86 is rotated by a motor 92 in operation and roller 88 is "coupled" to roller 86 by a mounting (not shown) in the sense that the movement of the yarn 80 in the direction of its own-length (at least in the nip line of the rollers 86, 88) is determined by the rotation of the roller 86. The motion of the yarn end 80A (FIG. 6) will correspond to the motion in the nip line, naturally provided that the yarn is kept taut between the nip line and the yarn end. This can ensured by introducing the yarn end 80A into the withdrawal duct 78, an air stream being generated through the duct 78 by the suction duct 66, again provided that the speed of the yarn does not exceed that of the air stream.

The armature of the motor 92 is rigidly connected to the roller 86 via a shaft 94 and is also connected to a tacho-generator (encoder) 96, which delivers signals to the control circuit 90. From these signals, the known properties of the motor 92 and set-values determined by an input unit 98 to fix a predetermined "running program", the control circuit 90 calculates the required power signal which is delivered to the motor 92 to run the "running program" through the motor 92.

To this end, the tacho-generator 96 delivers a high number of pulses (e.g. 2000) to the control circuit 90 per revolution of the motor shaft 94. This is equivalent to the fine sub-division of the yarn motion into "digital portions" (e.g., for a delivery roller diameter of 12 mm and 2000 pulses per revolution, the tacho-generator 96 transmits about 53 pulses per millimeter (mm) yarn motion to the control system). Under the above-mentioned conditions, the position of the yarn end 80A can therefore be determined continuously (or pseudo—continuously—with any desired accuracy dependent on the cost), starting from a known starting position to a target position in the rotor 60.

The control circuit 90 comprises a control processor 100;

a digital position controller 102 (in the form of a microprocessor) which receives a "running program" in the form of set-values from the processor 100 and pulses from the tacho-generator 96;

a power section 104 which receives a signal from the processor 102 and delivers a corresponding power signal to the motor 92; and a signal generator 106 which initiates the fiber feed via the transmitter 84 and sensor 82.

For each "position" of the "yarn end", the microprocessor 102 calculates both an actual-speed and an actual-acceleration and compares these values with the set-values determined by the running program. This comparison determines the output signal delivered to the power section 104 and, hence, fixes the power signal delivered to the motor 92. This comparison is carried out for each new pulse by the tacho-generator 96 so that the position control of the yarn end is "continuous'-'—the "continuity" can be increased by increasing the number of pulses per motor shaft revolution—although this higher accuracy involves higher cost (particularly in the signal processing).

If lower accuracy is acceptable, the calculation of the acceleration (or even the speed) can be eliminated for each position, with a corresponding reduction in costs. Even under these conditions, the system is distinguished from the known proposals (e.g. German Patent 27 11 554) in that the known solutions do not comprise a control circuit but rely on the drive system following the control signals delivered thereto. The system of FIG. 7 will continuously test the reaction of the system to the control signals and, when necessary, correct the system.

The signal processing in the processor 102 is carried out in accordance with algorithms defined by the control system manufacturer. Suitable control systems are available from the following companies: GALIL, Palo Alto, Calif., USA and Hewlett Packard.

Figure 7:
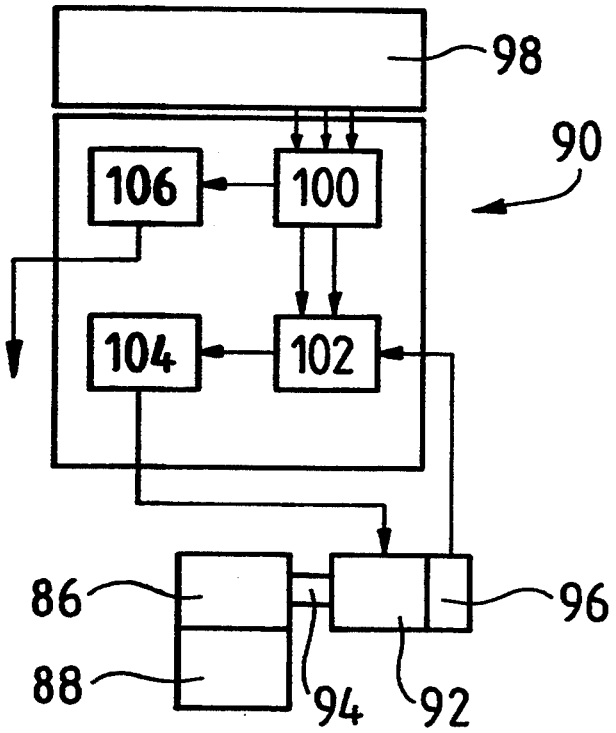
Figure 8:
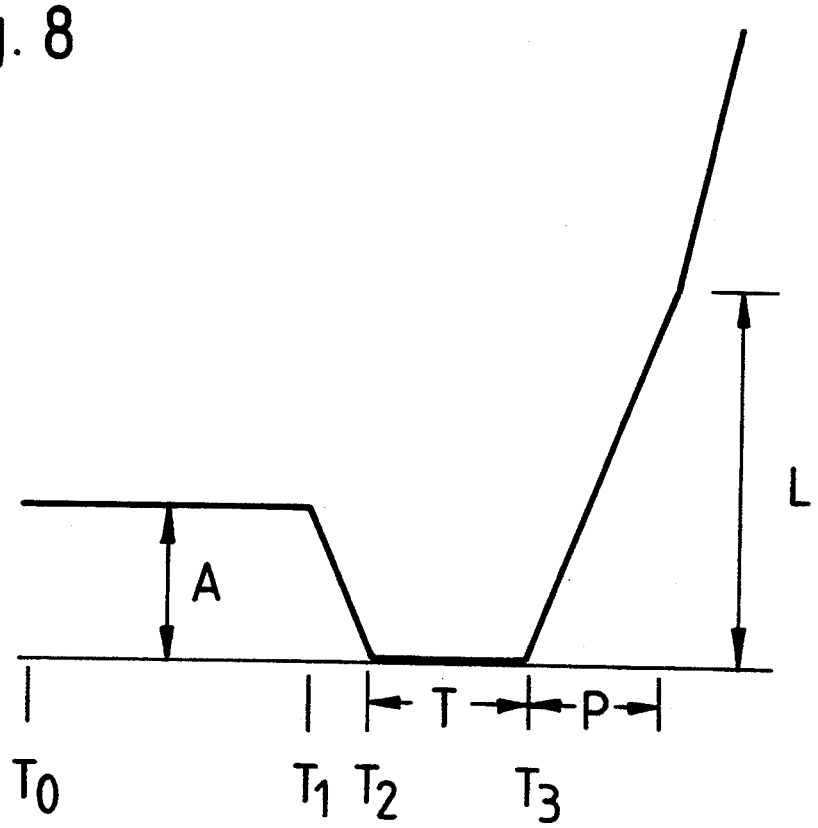

FIG. 8 is a time/distance diagram for a system of the kind shown in FIGS. 6 and 7, the yarn end position being shown on the vertical axis and the time on the horizontal axis. The "zero position" (target position) corresponds to the rotor groove 76 (FIG. 6). Upon operation, the control circuit delivers a signal via the transmitter 84 to initiate the fiber feed, the yarn end 80A maintaining a predetermined distance A (FIG. 8—for example 40 mm) from the rotor groove. At the time To, the yarn end is in the withdrawal duct 78, or at least in the rotor 60, the yarn return along the duct 78 also having been performed in accordance with a program determined by the control circuit 90 to guarantee continuous stretching out of the yarn.

At the time $T_1$, before conclusion of the formation of the fiber ring in the rotor groove 76, the movement of the yarn for penetration into this ring is initiated. In accordance with the program, this motion is carried out at a predetermined speed and is completed at the time T2, the position of the yarn end being continuously controlled as described hereinbefore.

It should be noted that the initiation of the fiber feed is a rapid operation but uncontrolled in its course. The fiber feed is initiated by a starting signal which, at the same time, represents the reference point for the parallel operation of the yarn feed. Reference to this point is by time. With a controlled yarn feed, the control functions are advantageously divided up over the control processor 100 and a digital yarn feed controller 102 (FIG. 7). The operation as a whole is initiated by the processor 100. This processor 100 can now give the starting signal for both operations with a chronological offset, the digital yarn feed controller 102 generating the required accuracy. Alternatively, the position of the yarn parallel to the position control circuit 90 can be compared with a threshold value which then starts the fiber feed purely in dependence on the yarn position.

The two operations are basically co-ordinated by the processor 100, the latter on the one hand starting the fiber feed directly, and on the other hand inputting and initiating the set-value sequence for the yarn feed. The yarn feed generally starts at an earlier time than the fiber feed.

After a predetermined residence time T, the control circuit 90 initiates withdrawal of the yarn 80 at the time T3. The withdrawal is carried out in two phases, i.e. a first phase P which is equivalent to withdrawal of a predetermined withdrawn yarn length L at a predetermined speed, and a second subsequent phase which is of indeterminate duration but with a higher predetermined operational speed (production speed) than the yarn speed during the first phase. The second phase is terminated when the yarn is delivered by the rollers 86, 88 (FIG. 6) to the machine withdrawal system (not shown).

During piecing in the rotor spinning machine, it is of maximum importance for the quality of the join, how the linear motion progresses in a zone corresponding to the first rotor phase P. There is, of course, a fiber ring in the rotor groove 76 but of a cross-section which has not yet levelled out due to continuous feeding and spinning. The fiber ring has a pronounced inhomogeneity due to being torn open by the withdrawn seed yarn. It is precisely in this area that individual adaptation can be made with the digital control system, the reduced withdrawal speed over the first rotor withdrawal phase P being applicable in the case illustrated (FIG. 8).

With the digital technique, it is possible to accurately control and link up with the fiber feed, yarn movements in a rapid chronological sequence over lengths corresponding to the periphery of the rotor 2. High flexibility is also obtained by programmable control.

Each modification of the sequence of movements is carried out in the software or by adjusting decade values. The control system is usable universally over wide ranges or adaptable to conditions.

Last but not least, the price for a simple mechanical system should be less than for a fairly complex arrangement which must be selected in order to obtain some accuracy in the handling of the yarn by means of clips, movable nippers and drive elements via stops and levers.

The quality of the join in the yarn using the digital position control technique is immediately much better than with the conventional techniques using automatic piecers. Although this result has been sought, the improvement in strength and uniformity is surprising and was not expected to this extent.

| Comparison yarn: Tested characteristic: | Cotton Ne 16 Tearing strength p (ponds) | Scatter % (Standard Deviation) (10 samples) |
|---|---|---|
| Yarn from bobbin | 352 | 6.5 |

-continued

| Comparison yarn: Tested characteristic: | Cotton Ne 16 Tearing strength p (ponds) | Scatter % (Standard Deviation) (10 samples) |
|---|---|---|
| AA join (automatic piecer without control circuit 90) | 139 (40%) | 34 |
| Automatic Piecer with control circuit 90 | 274 (78%) | 14 |

The principle of controlled yarn motion allows controlled introduction of the yarn end into the spinning unit throughout the range.

Since the yarn is always rapidly coupled to the feed motor and because the speed of the motion can always be adapted to technological requirements with the controlled drive, the yarn end can be so introduced into the rotor through the guide tube that the air stream always ensures a stretched position. It is well known that too fast a movement on entry to the rotor chamber causes the yarn end to rebound on the opposite wall, resulting in changes in structure which have a negative effect on the quality of the join.

Due to the rapid control which causes the yarn position always to follow the set values, the yarn end can be introduced exactly in coordination with the fiber feed and be withdrawn without, at any time, losing control of its exact position.

Thus, it is possible to always travel the same distances—which should be optimized in technology experiments—for the individual phases of the piecing operation at the same speed and, at the same time, accurately switch the fiber feed on and off appropriately.

As already stated, the control system is not of use solely in connection with rotor spinning. The control system can be used to determine the movement of a structure wherever an elongate structure is adapted to be coupled to a drive system controllable by a position control circuit.

Referring to FIG. 9, a servicing robot for a ring spinning machine carries a body, such as, a spindle 102 on an axis P about which yarn windings can be formed and an operating head for controlled formation of the yarn windings about the spindle 102. In addition, a tube (not shown) is carried on the spindle 102 to received the yarn windings.

The robot also has a carrier portion 220, a C-shaped holder 222 and a C-shaped servicing element 224 (which is rotatable about the axis P in a track 226 provided by the holder 222). The servicing element 224 has a toothed periphery 228, which meshes with two pinions 230 which, in turn, mesh with a toothed periphery 232 of a disc 231 directly connected with the shaft (not shown) of a drive motor 234 which serves as a drive means for the servicing element 224.

The servicing element 224 is provided with a clamping device 241 (FIG. 10) which comprises a pin 242 with a clamping head 246 and a (schematically indicated) spring bias 244. The pin 242 extends through a bore in the servicing element 224 and projects at both ends from the bore. The spring bias 244 exerts a biasing force on the pin 242 thereby normally pressing the clamping head 246 into contact with the underside of the servicing element 224 and forming a clamping position K. The pin 242 can be moved along the bore, in order to open the clamping device, by overcoming the effect of the spring loading. In operation, a yarn end to be moved is positioned between the clamping head 246 and the servicing element 224 while the clamping device 221 is open. The yarn end is then secured by closing the clamping device, i.e. the yarn end is connected to the servicing element 224. Then (after suitable positioning of the elements) a controlled winding operation can be carried out by setting the motor 234 in operation and transmitting the rotation of the motor shaft to the servicing element 224 by way of the pinions 230. The thread to be wound is dragged along with the clamping device (for example out of a suitable store) and forms yarn windings around the spindle 102 (or tube).

Figure 12:
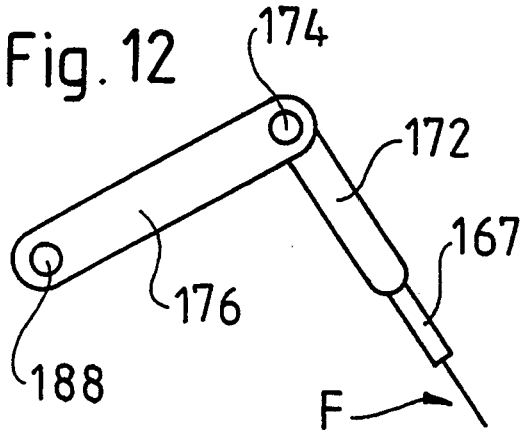
FIG. 12 illustrates a side view of a pair of pivotal levers of the system of FIG. 11.

Referring to FIGS. 11 and 12, the controllable movement system for a thread comprises two levers 172, 176 connected together by way of a pivot shaft 174 with a motor drive (not particularly indicated). One lever 176 is connected by way of a further pivot shaft 188 with a housing 190; with the pivot shaft 188 also provided with a non-indicated motor. The housing 190 is connected by way of a further, vertical pivot shaft 178 with a carrier 190; pivot shaft 178 also has its own motor (not shown). The other lever 172 carries an element in the form of a holder 168 at a free end for a mouth portion 167 of a thread store in the form, for example of a suction tube 165 connected to a non-illustrated suction system.

The stored thread F must be connected with an anchor point A. This point could be, for example, a clamping device in accordance with FIG. 9. However, FIG. 13 shows two further possibilities. In accordance with the first possibility (full lines), the thread F is an auxiliary thread which was wound onto a cop or a tube after a thread break to enable a restart of spinning. In accordance with a variant indicated in dotted lines, the thread F is withdrawn from the yarn body of the cop 116 itself (after a thread seeking operation). In both cases, the thread F is threaded with a traveller 108 carried by a spinning ring 106.

The motors of the pivot shafts 174, 178, 188 which act as drive means for the mouth portion 167 can now be set in operation to cause a controlled movement of the mouth end M of the mouth portion 167 in space and thereby to cause corresponding movement of the thread length between this mouth M and the traveller 108. The suction system holds the thread tensioned and the opening at the mouth M can be so dimensioned that the predetermined (programmed) movement of the mouth portion 167 is converted into a corresponding determined movement of the thread.

FIG. 14 shows a block diagram of a control circuit for controlling the arrangements in accordance with FIGS. 9 and 10, or FIGS. 11, 12 and 13. For the embodiment of FIG. 11, one control circuit each must be provided for the shafts 174, 178 and 188. To this end, each drive motor MT has a shaft MW which is coupled with the part L to be moved and cooperates with an encoder E to determine the position (angular disposition) of the shaft. The motor MT is supplied with energy by way of an amplifier AMP, the power delivered by the amplifier being determined by a digital to analog converter DAC. The output signal of the converter DAC is controlled by a regulator R which itself operates in dependence upon a comparator VGL.

The comparator VGL receives, on the one hand, a signal supplied by the encoder E, which corresponds to the current position of the shaft end W, and on the other hand, a set value supplied by a program section PR. The regulator R controls the motor MT in order to eliminate possible deviations between the current position (from the encoder E) and the set position (determined by the programming). The circuit can be designed in such manner that the shaft moves from any starting position with a predetermined movement characteristic to the end position determined by the programming.

A sensor S indicates, during start-up of the system, the position of the motor shaft MW, or of the part L to be moved, in relation to a reference (for example a frame not shown). Further, movements of the motor MT or of the shaft MW can be determined in relation to this starting position. In the complex system in accordance with FIGS. 11, 12 and 13, the movements of the three shafts 174, 178, 188 can be predetermined in relation to each other to move the mouth portion M along a programmable path in space.

Thus, it is not necessary to use a roller pair for delivery of a thread or other elongated body. It is also possible to secure two non-rotatable clamping elements to a lever in order to move the thread along a curved or straight path. The curved path may extend along only an arc of a circle and it may be necessary to assure fine division of the path into its component elements to ensure "continuous" control of the movement. The same applies to a linearly movable pair of clamping elements.

What is claimed is:

1. A system for controlling the movement of a yarn comprising first means including a pair of rollers defining a nip for moving a yarn longitudinally of the length thereof to move an end thereof from an initial position to a target position;

drive means connected to said first means for actuating said first means, said drive means being connected to one of said rollers to rotate said one roller for movement of the yarn through said nip;

a suction tube extending from said rollers to receive a length of the yarn;

a yarn severing means for severing a yarn within said tube to establish a yarn end; and a control circuit connected with said drive means for continuously controlling the position of said yarn end between said intial position and said target position, said control circuit controlling the speed of said drive means in dependence on the position of said yarn end between said initial position and said target position.

2. A system as set forth in claim 1 wherein said severing means is a grinding disc.

3. A system as set forth in claim 2 which further comprises a detector on said tube for detecting a broken yarn end, said detector being connected to said control circuit to emit a signal thereto indicative of the detection of a broken yarn end to establish said initial position of said one roller.

4. A system as set forth in claim 1 wherein said control circuit includes a digital position controller.

5. A system as set forth in claim 29 wherein said drive means includes a motor.

6. A system as set forth in claim 1 wherein said control circuit includes an encoder connected with said motor to emit an output signal representative of the position of said one roller, a power control element connected with said motor for controlling a current delivered to said motor for running said motor, and a digital position controller connected between and to said encoder and said control element, said controller having inputs for receiving a set-value signal for said target position, a set-value signal for a predetermined speed of said one roller for each position of said roller between said initial position and said target position, a set-value signal for a predetermined acceleration of said one roller for each position of said roller between said initial position and said target position and said output signal of said encoder, said controller having an output connected to said power control element to deliver a control signal thereto, said control signal corresponding to a difference between the predetermined speed and the actual speed of said one roller at each position of said one roller.

7. A rotor spinning machine comprising a rotor for spinning a yarn therein;

a cover mounted over said rotor and having a duct extending therethrough for passage of a yarn;

a piecing device for re-piecing a broken yarn in said rotor, said device including a pair of rollers aligned with said duct to define a nip for a yarn to move the end of the yarn between an initial position in said duct and a target position in said rotor and a motor for driving one of said rollers; and a control circuit connected to said motor for controlling the position of the end of the yarn in said duct and said rotor, said control circuit controlling the speed of said motor in dependence on the position of the yarn end between said initial position and said target position.

8. A rotor spinning machine as set forth in claim 7 wherein said control circuit is mounted on said piecing device.

9. A rotor spinning machine as set forth in claim 7 which further comprises a encoder connected to said motor to emit a continuous output signal representative of the position of said one roller between said initial position and said target position of a yarn end.

10. A rotor spinning machine as set forth in claim 9 wherein said control circuit includes an input unit to emit a set-value signal for said target position, a set-value signal for a predetermined speed of said one roller for each position of said roller between said initial position and said target position, and a set-value signal for a predetermined acceleration of said one roller for each position of said roller between said initial position and said target position;

a control processor connected to said input unit to receive said set-value signals and to generate a set-value program of speed for said motor in dependence on each position of the yarn end between said initial position and said target position;

a digital position controller connected to said processor to receive said program therefrom and connected to said tacho-generator to receive said output signal; and a power section connected to said controller to receive a power signal therefrom and connected to said motor to deliver a corresponding power signal thereto for controlling the speed of said motor.

11. A rotor spinning machine as set forth in claim 10 wherein said control circuit further comprises a signal generator connected with said'control processor to emit a signal to initiate a fiber feed to said rotor.

* * * * *

UNITED STATES PATENT AND TRADEMARK OFFICE

CERTIFICATE OF CORRECTION

PATENT NO. : 5,353,582
DATED : October 11, 1994
INVENTOR(S) : Giorgio Citterio, et. al.

It is certified that error appears in the above-indentified patent and that said Letters Patent is hereby corrected as shown below:

Column 11, line 57 after "position controller" insert -for controlling the speed of the drive means- Column 11, line 58 change "claim 29" to -claim 1-

Column 11, line 60 change "claim 1" to -claim 5-

Signed and Sealed this

Fourteenth Day of February, 1995

Bruce Lehman

*Attest:*

BRUCE LEHMAN

*Attesting Officer*

*Commissioner of Patents and Trademarks*